US005999759A

United States Patent [19]

Palumbo et al.

[11] Patent Number: 5,999,759

[45] Date of Patent: Dec. 7, 1999

[54] TONER CARTRIDGE WITH SELF IDENTIFICATION SYSTEM

[75] Inventors: Kenneth S. Palumbo, Rochester; Alan Goldsmith, Fairport, both of N.Y.

[73] Assignee: Xerox Corporation, Stamford, Conn.

[21] Appl. No.: 09/157,433

[22] Filed: Sep. 21, 1998

[51] Int. Cl.[6] ..... G03G 15/08

[52] U.S. Cl. ..... 399/27; 399/262

[58] Field of Search ..... 399/27, 28, 262, 399/263

[56] References Cited

U.S. PATENT DOCUMENTS

| | | | |
|---|---|---|---|
| 5,235,384 | 8/1993 | Oka et al. | 355/208 |
| 5,392,102 | 2/1995 | Toyoizumi et al. | 355/245 |
| 5,596,388 | 1/1997 | Ohkubo et al. | 399/111 |
| 5,634,169 | 5/1997 | Barry et al. | 399/12 |

*Primary Examiner*—Richard Moses
*Attorney, Agent, or Firm*—H. Fleischer; J. E. Beck

[57] ABSTRACT

A toner cartridge is mounted movably on a developer unit of a printing machine. The toner cartridge stores a quantity of toner particles therein. A bar code is provided on the exterior surface of the toner cartridge. The bar code provides information concerning the toner particles within the housing. A bar code reader periodically detects the bar code and transmits information to a processing unit indicating the characteristics of the toner cartridge. This enables discrimination between different toner cartridges, ensuring that the proper toner cartridge is installed in the developer unit of the printing machine. In addition, the processing unit, in response to receiving a signal indicating that the bar code has been detected, provides a signal indicative of the quantity of toner particles remaining in the toner cartridge. This signal is transmitted to a graphical user interface which displays the remaining quantity of toner particles in the cartridge.

13 Claims, 2 Drawing Sheets

TONER CARTRIDGE WITH SELF IDENTIFICATION SYSTEM

Figure 1:
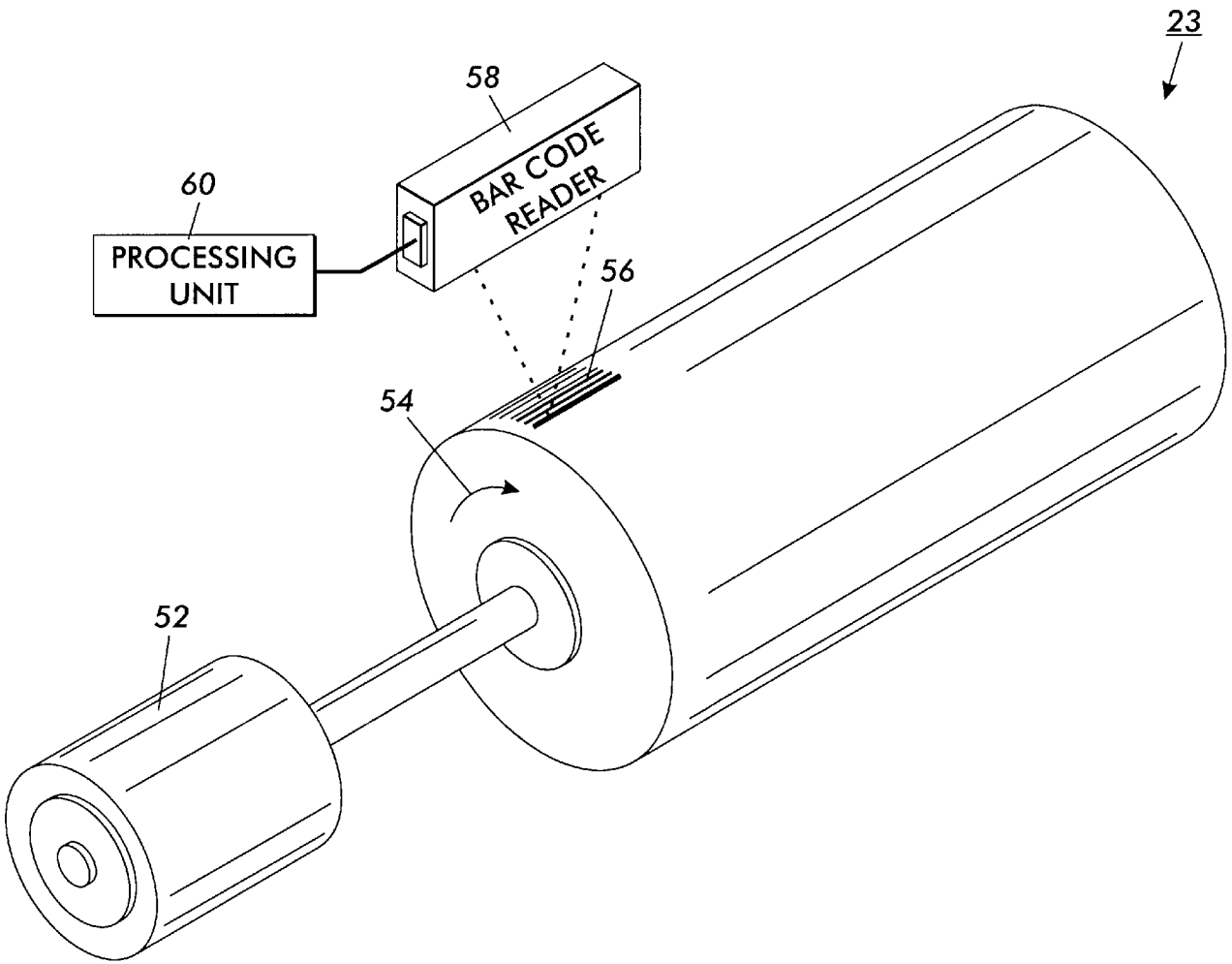

This invention relates generally to a development unit adapted for use in an electrophotographic printing machine, and more particularly, relates to dispensing toner particles into the developer unit and the detection of the remaining quantity of toner particles in the toner cartridge.

A typical electrophotographic printing machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained in the original document. After the electrostatic latent image is recorded on the photoconductive member, the latent image is developed by bringing a developer material into contact a therewith. Generally, the electrostatic latent image is developed with dry developer material comprising carrier granules having toner particles adhering triboelectrically thereto. The toner particles are attracted to the latent image forming a visible powder image on the photoconductive surface. After the electrostatic latent image is developed with the toner particles, the toner powder image is transferred to a sheet. Thereafter, the toner image on the sheet is heated to permanently fuse it thereto.

It is clear that toner particles are continually being depleted from the developer unit as successive electrostatic latent images are developed. Additional toner particles are discharged into the developer unit from a toner cartridge. The toner cartridge stores a supply of toner particles therein. However, as the toner particles are discharged, they are depleted from the toner cartridge. After all of the toner particles have been discharged from the toner cartridge, the empty toner cartridge is replaced with a new, full, toner cartridge. Frequently, cylindrical toner cartridges are utilized. These toner cartridges may be oscillated or rotated about their longitudinal axes so as to discharge toner particles from an opening in the bottom thereof or to convey toner particles to an end thereof for subsequent discharge from that end. In any event, regardless of the type of toner cartridge that is employed, it is highly desirable to indicate to the machine operator when the quantity of toner particles remaining in the cartridge are beneath a predetermined level, and when they are completely discharged from the toner cartridge. Hereinbefore, various sensors have been employed, such as piezoelectric sensors, for determining the quantity of toner particles remaining in the toner cartridge.

The following disclosures may be relevant to various aspects of the present invention:

U.S. Pat. No. 5,235,384
Patentee: Oka, et al.
Issued: Aug. 10, 1993
U.S. Pat. No. 5,392,102
Patentee: Toyoizuni, et al.
Issued: Feb. 21, 1995
U.S. Pat. No. 5,596,388
Patentee: Ohkubo, et al.
Issued: Jan. 21, 1997

U.S. Pat. No. 5,235,384 discloses counting the number of rotations of a toner supply roll. A pulse generator, mounted on one end of the roll, passes through a rotation sensor. The sensor counts the number of rotations.

U.S. Pat. No. 5,392,102 describes a bar code mounted on a flange of a developer container. The bar code permits discrimination between colors, destination, and other items for various containers.

U.S. Pat. No. 5,596,388 discloses a process cartridge for an electrophotographic printing machine having a bar code mounted on the frame thereof. The bar code has information concerning the main components of the process cartridge such as the photoconductive drum, the charging roll, and the cleaning blade. In this way, the history of the main components can be readily known by reading the bar code with a bar code reader.

In accordance with one aspect of the features of the present invention, there is provided a housing, mounted movably on a developer unit of an image forming apparatus, adapted to store a quantity of toner particles therein. The housing includes information indicia provided on the outer surface thereof. A sensor is operatively associated with the indicia to periodically detect the indicia and transmit a signal indicative of detecting the indicia. A processing unit, in communication with the sensor, receives the signal from the sensor and, in response thereto, provides an indication of the quantity of toner in the housing.

Pursuant to another aspect of the present invention, there is provided a developer unit including a housing mounted rotatably on the developer unit. The housing is adapted to store a quantity of toner therein. Information indicia is provided on the outer surface of the housing. A sensor is operatively associated with the indicia. The sensor periodically detects the indicia during movement of the housing and transmits a signal indicative of detecting the indicia. A processing unit, in communication with the sensor, receives the signal from the sensor and, in response thereto, provides an indication of the quantity of toner in the housing.

Still another aspect of the present invention is an electrophotographic printing machine of the type having a developer unit for developing an electrostatic latent image recorded on a photoconductive surface. The improvement includes a housing, mounted rotatably on the developer unit, adapted to store a quantity of toner therein. Information indicia is provided on an outer surface of the housing. A sensor is operatively associated with the indicia. The sensor periodically detects the indicia during movement of the housing and transmits a signal indicative of detecting the indicia. A processing unit is in communication with the sensor. The processing unit receives the signal from the sensor and, in response thereto, provides an indication of the quantity of toner in the housing.

Figure 2:
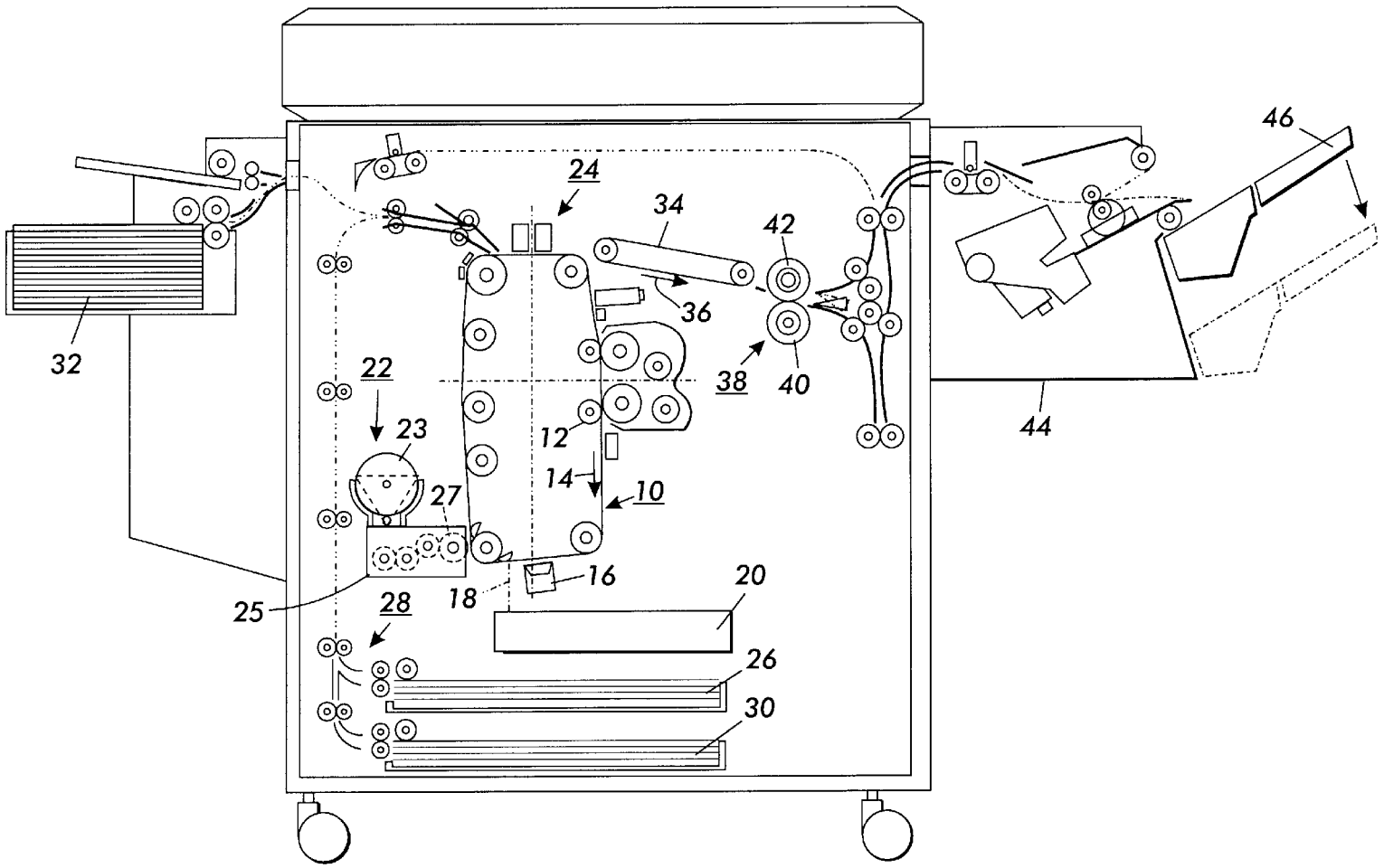

Other aspects of the present invention will become apparent as the following description proceeds and upon reference to the drawings, in which:

FIG. 1 is a schematic perspective view showing the toner cartridge of the present invention; and FIG. 2 is a schematic elevational view showing an exemplary electrophotographic printing machine incorporating the FIG. 1 toner cartridge in the developer unit thereof.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements.

Referring initially to FIG. 2, there is shown an electrophotographic printing machine having the features of the present invention therein. The printing machine employs a belt 10 having a photoconductive surface deposited on a conductive substrate. The photoconductive surface comprises an anti-curl layer, a supporting substrate layer, and an electrophotographic imaging single layer or multiple layers. The imaging layers may contain homogeneous, heterogeneous, inorganic, or organic compositions. Preferably, finely divided particles of photoconductive inorganic compound are dispersed in an electrically insulating organic resin binder. The substrate layer may be made from any suitable conductive layer such as Mylar®. Another well known conductive material that can be used in the substrate layer is aluminum. Belt 10 advances successive portions of the photoconductive surface sequentially through the various processing stations disposed about the path of movement thereof. A plurality of rollers or bars 12 provide support for belt 10. These rollers are spaced apart. Belt 10 advances in the direction of arrow 14. One of these rollers is rotatably driven by a suitable motor and drive (not shown) so as to rotate and advance belt 10 in the direction of arrow 14.

Initially, belt 10 passes through a charging station. At the charging station, a corona generating device 16 charges the photoconductive surface of belt 10 to a relatively high, substantially uniform potential.

After the photoconductive surface of belt 10 is charged, the charged portion thereof is advanced to an exposure station. At the exposure station, an imaging beam 18, generated by a raster output scanner (ROS) 20 illuminates the charged portion of the photoconductive surface. ROS 20 employs a laser with a rotating polygon mirror to record the electrostatic latent image on the photoconductive surface of belt 10. This electrostatic latent image is developed by developer unit 22.

Developer unit 22 includes toner cartridge 23 mounted rotatably thereon. As toner cartridge 23 rotates, it dispenses toner particles into developer housing 25. The developer material, including carrier particles and toner particles are advanced by roll transports to magnetic developer roller 27. Magnetic developer roller 27 deposits toner particles on the electrostatic latent image. In this way, the toner particles develop the latent image to form a toner powder image on the photoconductive surface of belt 10. Belt 10 continues to advance in the direction of arrow 14 to transfer station 24. Further details concerning toner cartridge 23 and its operation will be discussed hereinafter with reference to FIG. 1.

With continued reference to FIG. 2, at transfer station 24, a sheet of support material is advanced from a stack 26 by sheet feeders 28. Alternatively, the support material may be advanced from stack 30 or stack 32. In either case, the sheet of support material is advanced to transfer station 24 in registration with the toner powder image on belt 10. A corona generating device sprays ions onto the backside of the sheet of support material. This attracts the toner powder image from the photoconductive surface of belt 10 to the sheet of support material. A vacuum transport 34 moves the sheet of support material in the direction of arrow 36 to fusing station 38. While transferring the toner powder image to a receiving medium has been described wherein the receiving medium is a sheet of support material, e.g., paper, one skilled on the art will appreciate that the developed image may be transferred to an intermediate member, such as a belt or drum, and then subsequently transferred from the intermediate member to the sheet of paper and fused thereto.

Turning now to fusing station 38, fusing station 38 includes a heated fuser roller 40 and a backup or pressure roller 42. The backup roller is resiliently urged into engagement with the fuser roller to form a nip through which the sheet passes. In the fusing operation, the toner particles coalesce and bond to the sheet in image configuration. After fusing, the finished sheet is discharged to fusing station 44. At fusing station 44, sheets are compiled and stapled, and/or adhesively bound to one another. After the finishing operation is completed, the finished set of sheets is advanced to a catch tray 46 for removal therefrom by the operator.

Invariably, after the sheet is separated from the photoconductive surface of belt 10 at the transfer station, some residual particles remain adhering thereto. These residual toner particles are removed from the photoconductive surface at cleaning station 48. Cleaning station 48 includes a pair of rotatably mounted pair of fibrous brushes or a rotating brush and a blade, which are electrically biased, to attract particles from the photoconductive surface. The brushes are in contact with the photoconductive surface. Subsequent to cleaning, a discharge lamp (not shown) floods the photoconductive surface with light to dissipate any residual or electrostatic charge remaining thereon prior to the charging thereof for the next successive imaging cycle.

Referring now to FIG. 1, there is shown the detailed structure of toner cartridge 23. A suitable toner cartridge is described in U.S. Pat. No. 5,495,323, issued Feb. 27, 1996, to Meetze, Jr., et al., the relevant portions thereof being hereby incorporated into the present disclosure. Toner cartridge 23 includes a housing 50 defining a chamber for storing toner particles therein. Motor 52 is coupled to housing 50. As motor 52 rotates housing 50 in the direction of arrow 54, toner particles are advanced in the chamber of housing 50 from one end thereof to the other end thereof. An opening is provided at the other end to discharge the toner particles into developer housing 25 (FIG. 1). Information indicia 56 are located on the exterior circumferential surface of housing 50. Information indicia 56 includes a bar code. The information contained within the bar code may be the color of the toner particles in the toner cartridge, the serial number of the toner cartridge, the batch of toner material used therein, and the material characteristics. The bar code label has this information written thereon. In order to protect a label from contamination, an organic-proof transparent seal may be provided to cover the upper face thereof. Bar code reader 58 illuminates bar code 56 and receives light rays reflected therefrom The bar code reader detects the bar code and transmits this information to processing unit 60. The processing unit compares the information received from the bar code with stored information to determine that the appropriate toner cartridge has been installed within the developer unit of the printing machine. In the event an inappropriate toner cartridge has been installed, an error message is displayed on the printing machine graphical user interface. Thus, it is clear that the bar code contains extensive information concerning the characteristics of the toner cartridge. In addition, it is used as a means for discriminating between toner cartridges to ensure that the proper toner cartridge is installed in the developer unit of the printing machine. In addition to this feature, as the toner cartridge rotates, each rotation is detected by the bar code reader. Thus, the bar code reader detects the bar code each time it passes therebeneath. This information is transmitted to processing unit 60. Processing unit 60 contains an algorithm which multiplies the number of revolutions of housing 50 by the toner discharged per revolution, and subtracts this from the initial quantity of toner particles in housing 50. This information is displayed on the graphical user interface of the printing machine and indicates the remaining quantity of toner particles within housing 50. Processing unit 60 achieves the foregoing by using a counter which counts the number of revolutions of housing 50, and multiplies this number by the appropriate scale factor to determine the quantity of toner particles discharged from housing 50. Inasmuch as the original quantity of toner particles in housing 50 is stored in processing unit 60, the difference results in the remaining quantity of toner particles within housing 50.

In recapitulation, it is clear that the present invention is directed to determining the quantity of toner particles remaining in a toner cartridge by utilizing information indicia on the exterior circumferential surface of the toner cartridge which provides, in addition, characteristics of the toner cartridge permitting discrimination between toner cartridges.

It is, therefore, apparent that there has been provided in accordance with the present invention, a toner cartridge which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

We claim:

1. A housing, mounted movable on a developer unit of an image forming appratus, adapted to store a quantity of toner therein wherein the housing is mounted rotatably on the developer unit and discharges toner therefrom during rotation thereof, including:

information indicia provided on an outer surface of the housing;

a sensor, operatively associated with said indicia, to periodically detect said indicia and transmit a signal indicative of detecting said indicia; and a processing unit, in communication with said sensor, for receiving the signal from said sensor and, in response thereto, providing an indication of the quantity of toner in the housing.

2. A housing according to claim 1, wherein said sensor detects said indicia each cycle of rotation.

3. A housing according to claim 2, wherein said indicia includes a bar code.

4. A housing according to claim 3, wherein said bar code includes information pertaining to at least one of batch number, color, material properties, and serial number.

5. A developer unit, including:

a housing, mounted movably on the developer unit, adapted to store a quantity of toner therein, said housing is mounted rotatably on the developer unit and discharges toner therefrom during rotation thereof;

information indicia provided on an outer surface of said housing;

a sensor, operatively associated with said indicia, to periodically detect said indicia during movement of said housing and transmitting a signal indicative of detecting said indicia; and a processing unit, in communication with said sensor, for receiving the signal from said sensor, and, in response thereto, providing an indication of the quantity of toner in said housing.

6. A developer unit according to claim 5, wherein said sensor detects said indicia each cycle of rotation.

7. A developer unit according to claim 6, wherein said indicia includes a bar code.

8. A developer unit according to claim 7, wherein said bar code includes information pertaining to at least one of batch number, color, material properties, and serial number.

9. An electrophotographic printing machine of the type having a developer unit for developing an electrostatic latent image recorded on a photoconductive surface, wherein the improvement includes:

a housing, mounted movably on the developer unit, adapted to store a quantity of toner therein, said housing is mounted rotatably on the developer unit and discharges toner therefrom during rotation thereof;

information indicia provided on an outer surface of said housing;

a sensor, operatively associated with said indicia, to periodically detect said indicia during movement of said housing, and transmitting a signal indicative of detecting said indicia; and a processing unit, in communication with said indicia, for receiving the signal; from said sensor and, in response thereto, providing an indication of the quantity of toner in said housing.

10. A printing machine according to claim 9, wherein said sensor detects said indicia each cycle of rotation.

11. A printing machine according to claim 10, wherein said indicia includes a bar code.

12. A printing machine according to claim 11, wherein said bar code includes information pertaining to at least one of batch number, color, material properties, and serial number.

13. A printing machine according to claim 9, wherein said housing is mounted removably on the developer unit, said housing being subsequently adapted to be returned to the developer unit, and said information indicia coupled with said sensor providing the quantity of toner remaining in said housing when said housing is returned to the developer unit.

* * * * *